United States Patent [19]

Miyachi et al.

[11] 4,137,857

[45] Feb. 6, 1979

[54] BELT LOOPER APPARATUS

[75] Inventors: Nobuji Miyachi; Keniti Miyake, both of Kyoto; Akira Ogawa, Uji, all of Japan

[73] Assignee: Miyachi Sewing Machine Co., Ltd., Kyoto, Japan

[21] Appl. No.: 827,956

[22] Filed: Aug. 26, 1977

[30] Foreign Application Priority Data

| | | | |
|---|---|---|---|
| Sep. 10, 1976 | [JP] | Japan | 51-109209 |
| Sep. 10, 1976 | [JP] | Japan | 51-109210 |
| Apr. 27, 1977 | [JP] | Japan | 52-49469 |

[51] Int. Cl.[2] ..... D05B 3/12

[52] U.S. Cl. ..... 112/121.27

[58] Field of Search ..... 112/121.27, 121.26, 112/104, 130, 147, 152

[56] References Cited

U.S. PATENT DOCUMENTS

| | | | |
|---|---|---|---|
| 3,699,907 | 10/1972 | Anderson et al. | 112/130 X |
| 3,780,680 | 12/1973 | Shuffield | 112/130 X |
| 3,792,672 | 2/1974 | Friedman et al. | 112/104 |
| 3,799,088 | 3/1974 | Marforio | 112/130 |
| 3,841,247 | 10/1974 | Off et al. | 112/121.27 |
| 4,048,931 | 9/1977 | Hodgins | 112/121.27 |

*Primary Examiner*—Peter Nerbun

[57] ABSTRACT

A belt looper apparatus comprises a delivery means, an accepting means, a cutter, a folding means, a sewing machine, a movable guide, a garment-pressing means and a slackening means, wherein said movable guide and said garment presser are adapted to move in a direction equivalent to that of the delivery of the material.

19 Claims, 35 Drawing Figures

M
50
51
52
52a
52b
53
54
55
56
57
58
59
60
61
62
63
64
65
66
67
68
69
69a
70
71
72
73
74
75
76
77
78
79
80
81
82
83
87
88
89
90

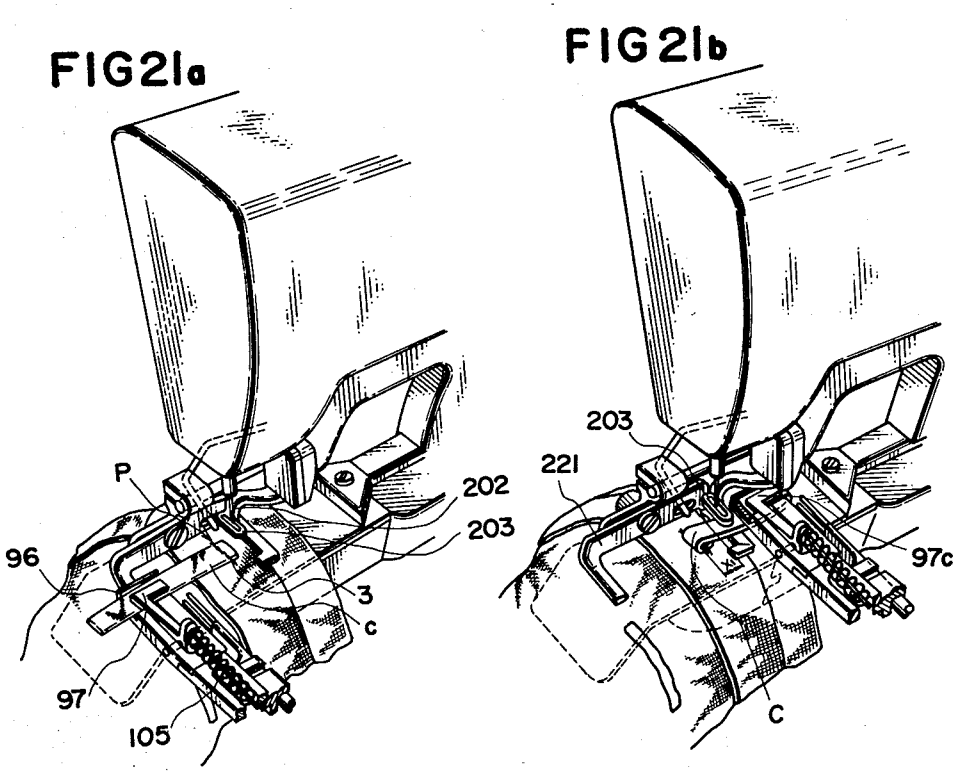
FIG21b
203
221
97c
C
FIG21a
P
96
97
105
3
c
202
203
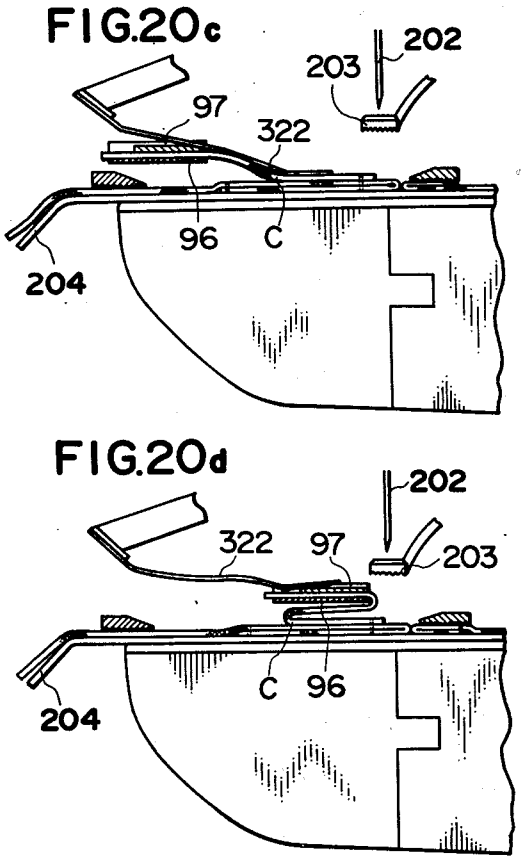
FIG.20c
202
203
97
322
96
C
204
FIG.20d
202
203
97
96
322
C
204

202
310 C
221
97
4
3

202
203
96
97
310
c
185
184

202
203
221
4
3
2

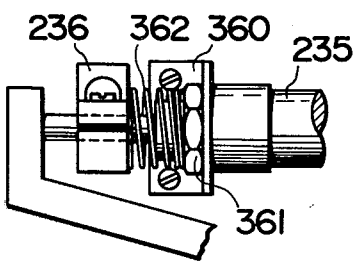
FIG.24
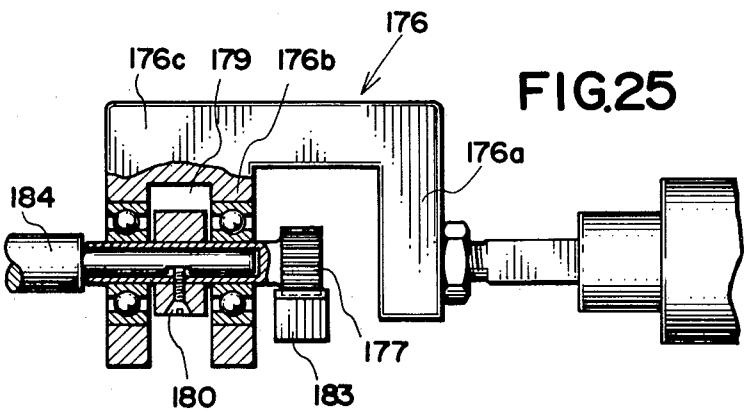
FIG.25
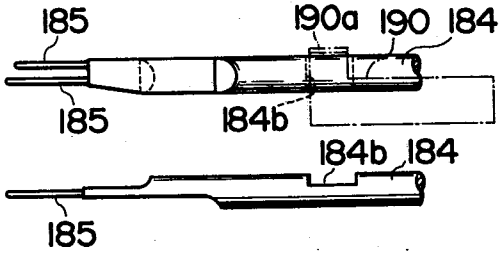
FIG.22a
FIG.22b
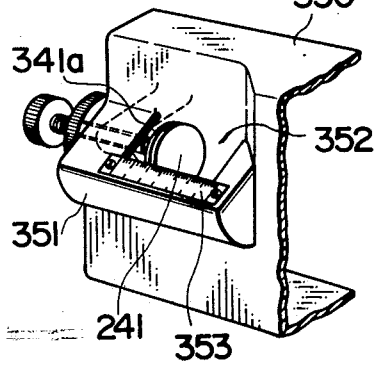
FIG.23

BELT LOOPER APPARATUS

The present invention relates to a belt looper apparatus, and more particularly to an apparatus for sewing a cut piece automatically onto a garment in such a manner that one end of the cut piece is folded up in the form of a letter S while the other end thereof is folded over downward at an angle of 180° with the remaining portion.

In the manufacture of various articles of clothing, for example slacks and trousers, a number of belt loops must be sewn to the garment. Generally, this operation is performed manually. The belt loops sewn to the garment can be classified largely into three types. One of them is meant specially for the pants, dungarees, and jeans and is provided with folded end portions folded over at an angle of 180° on both ends of a cut piece, which then is sewn to the garment by the sewing machine on the upper side of these folded ends thereby resulting in seams appeared outwardly on both end portions.

A belt loop of the second type has an end folded in a letter S where the seam is formed not to be seen from the outside, and the other end folded over at an angle of 180° is sewn to the garment from the upper side of the cut piece thereby forming a seam appeared outwardly.

A belt loop of the third type has both ends folded over in a S-shape and the sewing at each end is so carried out as not to show the seam outwardly. Belt loops of these second and third types are used particularly for slacks and trousers for men.

As an example of the apparatus in which the belt loops are automatically sewn to the garments, as said first type, the U.S. Pat. No. 3,699,907 can be referred to. The applicant of the present invention has developed a belt looper apparatus of a structure completely different from this U.S. Patent, and filed applications to the U.S., England, West Germany as well as Japan (Japanese Patent Application No. 45262/76 etc., U.S. Ser. No. 786,141 now U.S. Pat. No. 4,114,544, British Patent Application No. 15051/77, German Patent Application No. P2,716,916.0).

However, up to now, no apparatus has been developed for automatically sewing the belt loops of said second and third types onto the garment, as far as known by the applicant. The object of the present invention is to provide an apparatus for automatically sewing the belt loop of the second type onto the garment.

As aforementioned, the objective belt loops in the present invention used to be manually sewn and accordingly the manufacturing cost of the garments were high and the work efficiency was low. Namely, in the sewing work of the conventional belt loops, even a skilled craftsman took about 20 seconds to sew one belt loop and besides the sewn lengths could not be perfectly the same.

Another object of the present invention is therefore to provide an apparatus in which the belt loops are automatically sewn and thereby the work efficiency is improved and the manufacturing cost is reduced. According to the present invention, a belt loop is sewn in about 10 seconds without requiring a skilled craftsman, which fact not only improves the work efficiency to more than two times as much as said usual one achieved by skilled craftsman, but also realizes a precise and uniform sewing which is greatly advantageous for a practical application to industry.

Another object of the present invention is to provide an apparatus for automatically eliminating the seams included in the material for the belt loop for the purpose of interconnecting therebetween and thereby preventing the debasement of the appearance of the garment to be caused by said seams if sewn thereto.

Another object of the present invention is to provide an apparatus in which a space is formed between the garment and the belt loop sewn thereto so as to allow the belt to move loosely through said space.

Another object of the present invention is to provide an apparatus which is adapted to protect the cut piece from hitting against the presser at the sewing part when the cut piece is reversed after the first sewing in the process of forming a belt loop by sewing a cut piece onto a garment.

Further objects and advantages of the present invention will become more apparent from the following detailed descriptions upon reference to the attached drawings.

FIGS. 1 (a)–(c) are perspective views illustrating various embodiments of band loops, wherein FIG. 1(b) shows a band loop formed by an apparatus according to the present invention;

FIG. 6 and FIG. 7 are elevational views of the seam detecting means shown in FIG. 4, wherein FIG. 6 shows a state in which no seam is seen, while FIG. 7 shows a state in which a seam is detected;

FIG. 11 and FIG. 12 are elevational views of those shown in FIG. 10, wherein FIG. 11 illustrates a starting position, while FIG. 12 shows an ending position;

FIGS. 20(a)–(d) illustrate how the folding back is performed;

FIGS. 21(a)–(e) illustrate the movement of the cut piece to be sewn by the apparatus according to the present invention;

FIG. 22 illustrates fingers and their periphery, wherein (a) is an elevational view and (b) is a state rotated in a 90° arc from the position of (a);

FIG. 23 is a perspective view of a scale which facilitates controlling the degree of draw back of the garment presser corresponding to the length of the belt loop;

FIG. 24 is an elevational view of a means to absorb shocks caused by the movement of the garment presser of the garment pressing mechanism.

FIG. 25 is a cross sectional view partly illustrating a coupled member which is provided with a shaft and a pinion.

Figure 1A:
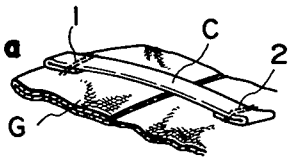
Figure 1B:
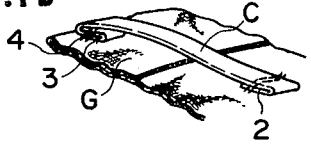
Figure 1C:
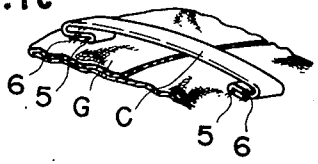

Prior to explaining the structure of each portion of the present invention, an explanation as to the belt loop which is the object of the present invention will be given. As is shown in FIG. 1(a), aforementioned first type which is meant mainly for jeans and pants is formed in such a manner that both ends of the cut piece C are folded down at an angle of 180° with the cut piece C and the seams 1, 2 are formed thereon from above and thereafter the belt loop is sewn to the garment G. The application for the apparatus for manufacturing this belt loop is already filed as aforementioned. Shown in FIG. 1(b) is said second type which is formed in such a manner that one end of the cut piece C is at first provided with a seam 3 and then the cut piece C is folded over to form a seam 4 and thereafter once again the cut piece C is folded over thereby producing an S-shaped sewn portion. The other end of the cut piece is folded down at an angle of 180° with the cut piece and a seam 2 is formed and then the belt loop is sewn. The belt loop of this type is the object of the present invention. Shown in FIG. 1(c) is said third type which has seams 5, 6 on both ends and inside of the cut piece C. This type is not related to the present application.

Figure 2:
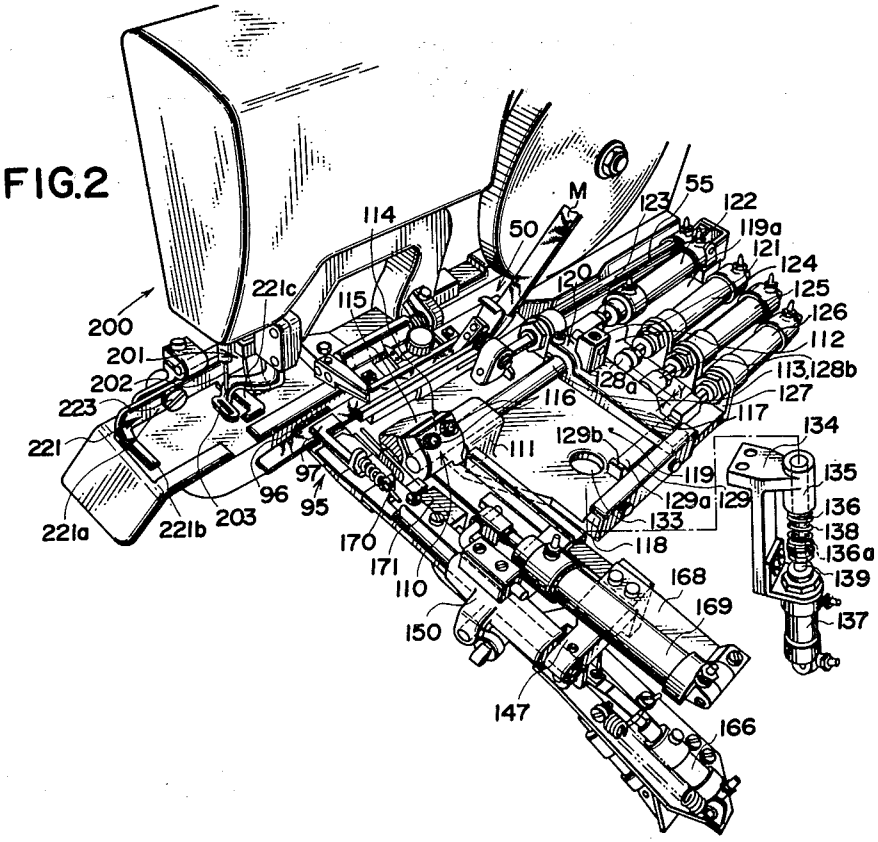
FIG. 2 is a perspective view of the whole apparatus according to the present invention.
Figures 3, 4:
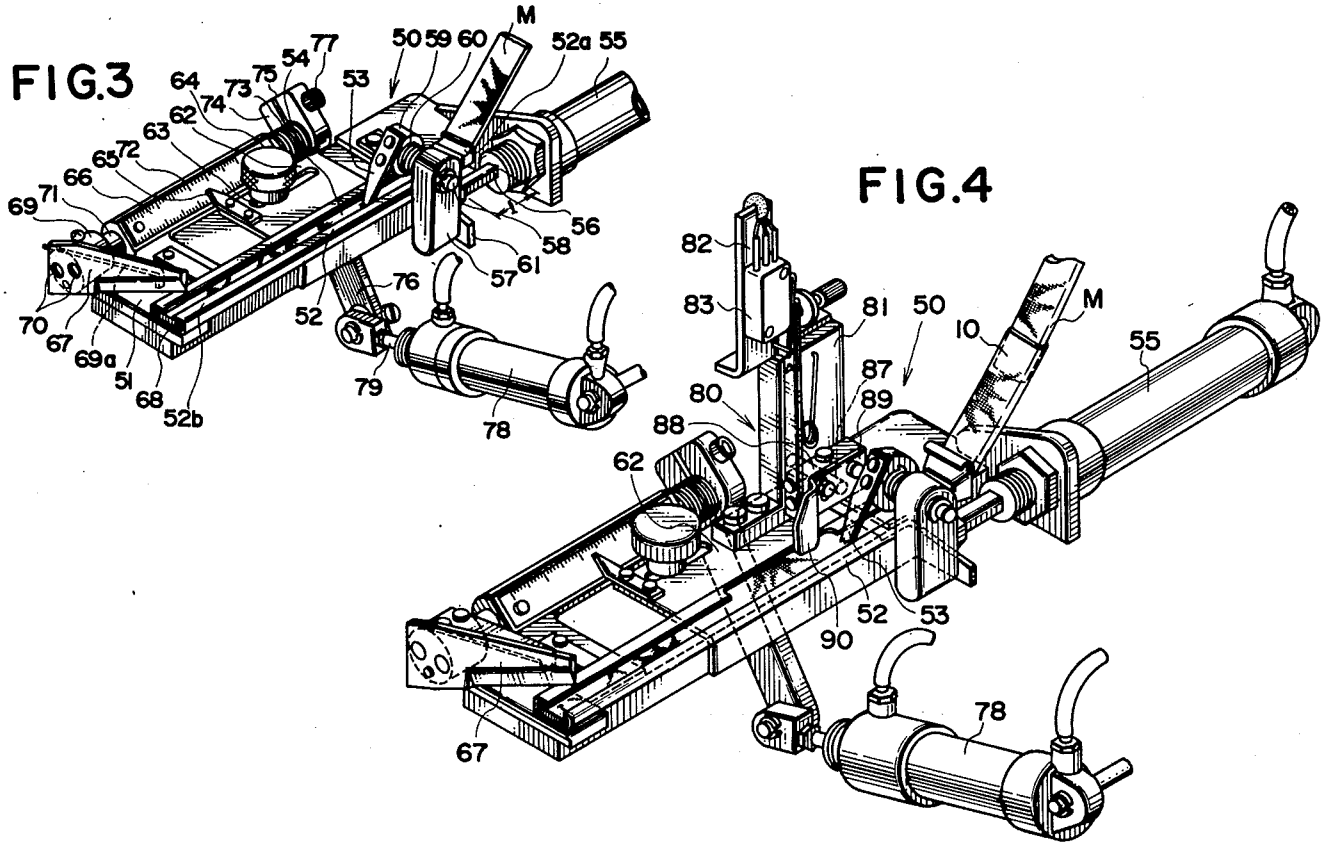
FIG. 3 is a perspective view of a delivery means.
FIG. 4 is a perspective view of the delivery means provided with a detecting means for seams.

A delivery means 50 is substantially of the same structure as that of the former application, and as shown in FIGS. 2 and 3, a trough 52 having a substantially C-shaped cross-section is provided over a certain interval on a supporting plate 51 which is to be fixed on a base (not shown) juxtaposed with the sewing machine. The delivery means 50 guides in an elongated material M from one end 52*a* of the trough 52 and delivers said material M through the other end 52*b* with the working of a delivery pawl 53. The inlet end 52*a* of the trough 52 is widened toward the end so as to facilitate the introduction of the material M, while the cross-sectional shape of the trough is adapted to prevent the sideward and vertical movements of the material M therein and to smoothly feed out the material M. Said delivery pawl 53 is inserted to an opening 54 at the upper part of the trough 52. This delivery pawl 53 is drawn back and forward by an air cylinder 55. As an air cylinder, similarly to the former application, a rectangular rod is preferred. A holder 57 is fastened on top of the rod 56 of the air cylinder 55, and the delivery pawl 53 is pivotally mounted on the holder 57 cantileveringly through a shaft 58 and a bracket 59. A coil spring 60 gives the delivery pawl 53 a constant downward counterclockwise pivoting power. As the result of this pivoting action, the delivery pawl 53 thrusts into the material M to ensure the sending of the material when it takes the position shown in FIG. 3, and after finishing the feed-out of the material the delivery pawl 53 retreats sliding over the surface of the material M. A rear end of the holder 57 contacts a stopper 61 in order to limit the drawing back of the holder, and due to this fact the withdrawal length of the delivery pawl 53 is limited thereby enabling the adjustment of the delivery length per unit, namely the stroke L of the air cylinder 55 minus withdrawal-prohibiting length l. The stopper 61 is projecting from a supporting member 62 having an L-shaped cross-section. This supporting member 62 is located in a space between the supporting plate 51 and the trough 52, and an elongated bore 63 and a fastening knob 64 screwed into the plate 51 are adapted to allow the stopper 61 to move on and fix to the plate 51. Numeral 65 designates an indicating pointer which indicates scales on a scale plate 66. Feeding amount of the material for one time is measured by this scale.

A cutter 67 in cooperation with an edge 68 provided at an end of the supporting plate 51 cuts the material M. The cutter 67 is secured to an end of a boss 69 with screws 70, and said boss 69 is formed on the edge of a shaft 71 being the size of the diameter of the shaft 71. A plate spring 69*a* with its tip folded downwards is fastened to the boss 69 which is pivoted thereby pivoting the cutter 67 and simultaneously the plate spring 69*a* pressing the material M with its folded tip. Thus, the delivery pawl 53 is drawn back to its original position while the material is pressed by the plate spring. Therefore, the material once fed is not drawn back by the return stroke of the delivery pawl 53 which singly retreats to its original position sliding over the surface of the material. The shaft 71 is rotatably supported in a sleeve 72 and receives an axial force due to a spring 73. Owing to this spring force, the contact pressure between the cutter 67 and the edge 68 is controlled. On the other end of the shaft 71, a jaw 74 and a jaw 75 provided on one end of a crank lever 76 are tightenedly secured with a bolt 77. When the bolt 77 is loosened and the jaws 74, 75 are pressed toward the cutter 67 while holding the side of the cutter 67, the spring 73 is compressed thereby raising the contact pressure of the cutter 67 and the edge 68. A rod 79 of a pivoting air cylinder 78 is pinned on the lower end of the crank lever 76. The material is cut by the backward and forward movement of the rod 79 which accordingly pivots the cutter 67. Part of the sleeve 72 is flat where said scale plate 66 is fixed. Representations on the scale 66 shows said value of (L-l).

Figure 5:
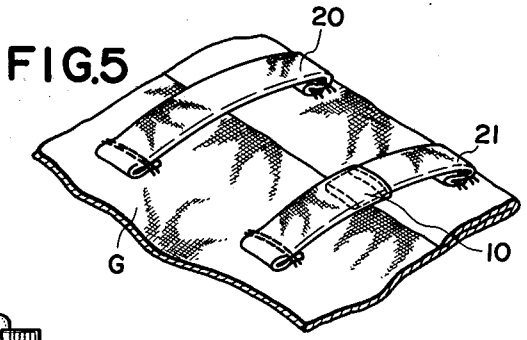
FIG. 5 is a perspective view of a part of a garment to which a cut piece having a seam portion is sewn.
Figure 7:
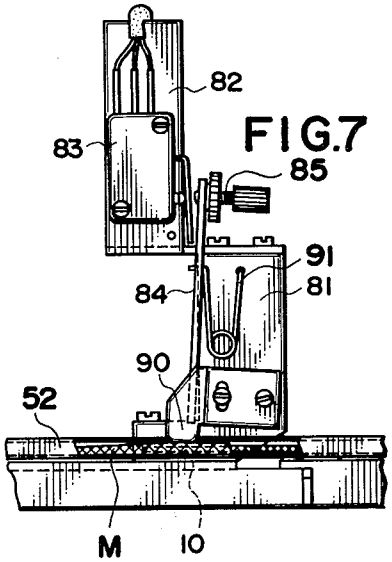
Figure 6:
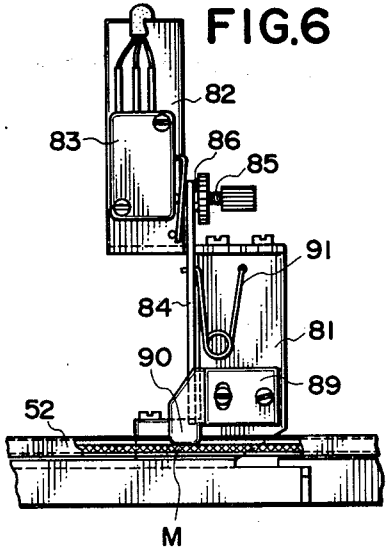

Shown in FIGS. 4 and 6 are examples wherein a delivery means is provided with a detecting means 80 for a seam portion. The material M is prepared separately beforehand, and is supplied into the apparatus of the present invention in a form of a consecutive oil including a seam portion 10 therein. If this seam portion 10 is led into a cut piece, the band loop sewn to the garment G includes the seam portion 10, as shown in FIG. 5, with which the band loop looks much poorer than a normal band loop 20 having no seam portion. Therefore it is necessary to detect this seam portion 10 and eliminate a cut piece 21 including this portion automatically thereby avoiding sewing such a cut piece onto the garment. A supporting block 81 is fastened by screws on said supporting member 62, and a plate 82 is fastened by screws on the upper end of the supporting block 81. A micro switch 83 is fastened to this plate 82 and the tip of a screw 85 fixed to the upper end of a lever 84 is adapted to perform a to-and-fro motion and contact the micro switch. Designated by the numeral 86 is a lock nut which is loosened when the protruding length of the screw 85 is adjusted. The lower end of the lever 84 is fixed to a block 88 which is fastened to a shaft 87 rotatably fixed to the supporting block 81. This block 88 is further provided with a detecting plate 89 and a detecting portion 90 downwardly projecting therefrom is allowed to contact the surface of the material M delivered in the trough 52 by the action of a spring 91. If a seam portion 10 is included in the material, as shown in FIG. 7, the detecting portion 90 is thrusted up and the lever 84 is rotated against the force of the spring 91 and thereby the micro switch 83 is released from the contact and the detection is thus carried out. The detecting portion 90 is arranged closely to said delivery pawl 53.

At the outlet of the trough of the delivery means 50 an accepting means 95 which is adapted to receive the fed material and after cutting the material deliver the cut piece to the position of the sewing head of the sewing machine located transversely is provided. This accepting means 95 is provided with an accepting member 96 and a presser member 97 on the tip thereof and is adapted to receive the material fed from the trough between these two members and deliver the material to the sewing head in a manner held therebetween. The accepting means 95, together with a folding means 170 located nearer to the trough than the accepting means 95, is supported by a movable guide 110 and moves in a direction crossing at right angles with that of the movement of the movable guide 110.

Figure 8:
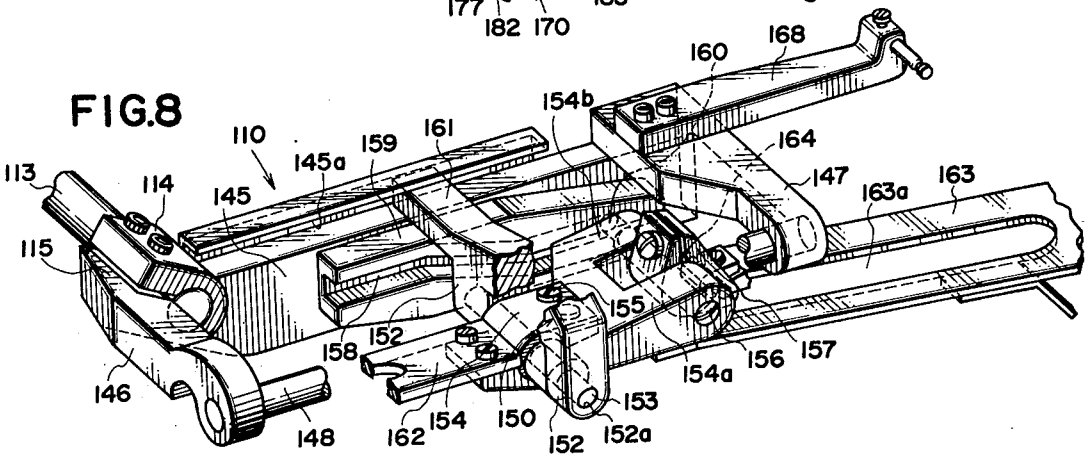
FIG. 8 is a partially broken perspective view illustrating a main portion of a movable guide.

By means of jaws 114, 115 and a bolt 116 the movable guide 110, as shown in FIGS. 2 and 8, is fastened to the end of a shaft 113 slidably arranged by bearings 111, 112. The shaft 113 is provided with a detent by means of a detent plate 117 the end of which is inserted into a guide groove 118. Said bearings 111, 112 and the guide groove 118 are integrally formed through a plate 119, and are fastened on the base (not shown) together with the plate 51 of the delivery means 50 and are disposed at a certain position to the sewing machine.

Said detent plate 117 is fastened to the shaft 113 through jaws 120 and a rod 123 of an air cylinder 122 is pinned to a block 121 protruding from the detent plate 117. As a result of this disposition, the shaft 113 and accordingly the movable guide 110 fixed to the end thereof are moved backward and forward by the air cylinder 122. The rear end portion of the shaft 113 is long enough to project from the rear bearing 112 even when the air cylinder 122 extends the rod to the stroke end, i.e., not to disconnect the rear end portion of the shaft 113 from the bearing 112.

The rear end of said air cylinder 122 is pinned to a supporting base 119*a* projecting rearwardly from said plate 119 and air cylinders 124, 125, and 126 are fastened on a bracket 127 projecting upwardly from the rear end of said plate 119.

The air cylinders 124, 125 are provided with column members 128*a*, 128*b* at the ends of the rods thereof, wherein the member 128*b* is located in the rear of the detent plate 117 while the other member 128*a* is shorter by Y than the member 128*b*.

The rod of the air cylinder 126 has a partly cutaway square rod 129 having a horizontal portion 129*a* and a perpendicular portion 129*b* on the end thereof, wherein the horizontal portion 129*a* is disposed in the aperture between the detent plate 117 and the plate 119.

Figure 9:
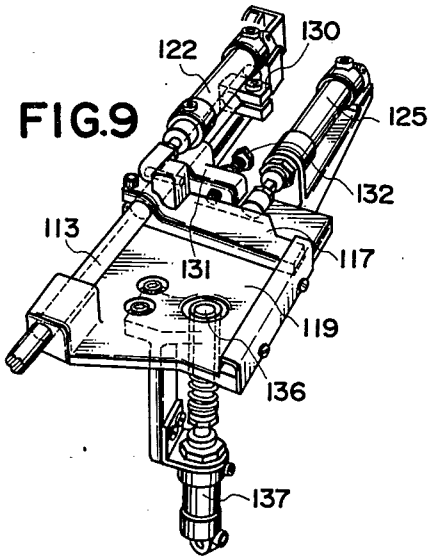
FIG. 9 is a perspective view illustrating a modified embodiment of a rear end portion of a rod which moves a movable guide.

The function of each cylinder 124, 125, and 126 is described later. From among said cylinders 124, 125, and 126, the cylinders 124 and 126 and the square rod 129 connected to the latter may be eliminated and the structure as follows may be adopted. Namely, as shown in FIG. 9, a stopper 130 is provided on the shaft 113 movably and fixably thereto and a threaded block 131 is projecting from the bearing 112 and the bolt 132 is screwed into this threaded block 131. This bolt 132 controls the return length of the detent plate 117. Either of these structures can be chosen according to the relations with the loosening mechanism for the belt loop sewn to the garment. A bore 133 is formed in the plate 119 and a column 136 which slides in a sleeve 135 formed on a bracket 134 is adapted to project upward from this bore 133. The bracket 134 is fixed to the lower part of the plate 119, and supports a double acting air cylinder 137 and the upper end portion of the rod of this cylinder is inserted into a hole 136*a* fixed to the lower end of said column 136, whereby the column 136 is lowered by the action of the spring 138 and lifted by the action of the air cylinder 137. The numeral 138 designates a spring which presses down a rod 139 of the cylinder, and this spring 138 normally prevents the member 136 from projecting from the plate 119. It is also possible to use a single acting air cylinder instead of the double acting one employed in the embodiment shown in the drawing in order to carry out said function.

In the movable guide 110, as shown in FIG. 8, a vertical plate 145, said jaws 114 and 115 are integrally formed, and from the fore end and the rear end of this vertical plate brackets 146, 147 are projecting sideways and a rod 148 is horizontally secured therebetween. A movable bracket 150 is movably fixed to the rod 148, and is adapted to move the receiving means 95 and the folding means 170 to the direction crossing at right angles with that of the movable guide 110.

Figure 11:
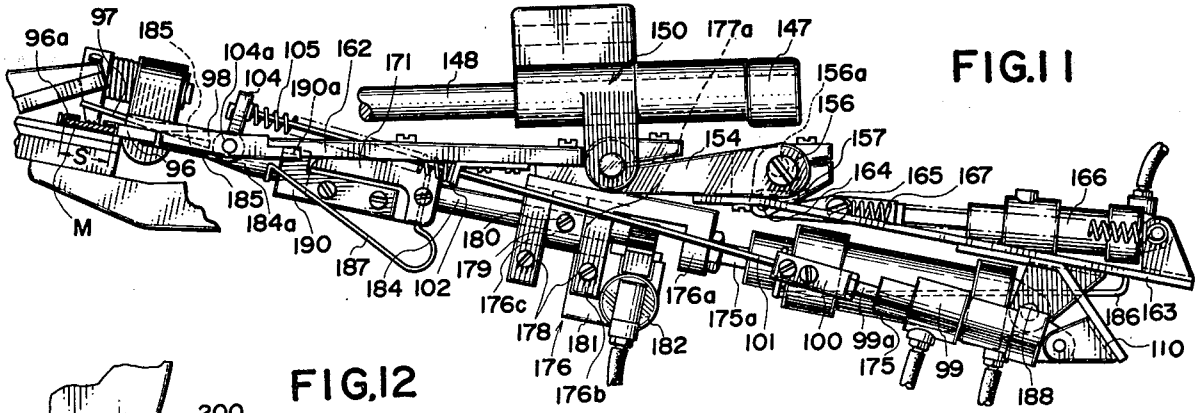

The movable bracket 150 is provided with a cylindrical sliding portion 151 which slides along on the rod 148, and a pair of arms 152, 152 projecting downward from this sliding portion 151, and a shaft 153 is rotatably secured to bearings 152*a*, 152*a* formed on each arm, and further, a supporting member 154 is secured to the shaft 153 by a screw 155. The supporting member 154 has a substantially Y-shaped plane, and a shaft 156 is rotatably fixed between an arm 154*a* and an arm 154*b*, wherein the inside end of the shaft 156 is projecting beyond the arm 154*b* to the direction of the vertical plate 145 and the projecting end thereof is formed as an accentric shaft 156*a*(FIG. 11). A clamping means 157 is secured by a screw on the shaft 156 between the arm 154*a* and the arm 154*b*.

On the inside of the side portion of the vertical plate 145 secured is a member 159 having a grooved cam 158, with which, as shown in FIG. 8, a roller 160 fixed to a shaft 156*a* provided on the end of said shaft 156 is engaged, and with the movement of the movable bracket 150 the shaft 153 is slightly rotated and thereby the supporting member 154 is rotated. As the result of the rotation of the supporting member 154, each end of the receiving means 95 and the folding means 170, each to be fixed on this supporting member 154, move along a curved track similarly to the prior application. This is for the purpose of protecting the operator's hand from being hit by each end portion.

A slider 161 is projecting toward the inside from the cylindrical sliding portion 151 of the movable bracket 150, namely toward the vertical plate 145, and is adapted to slide along within a groove 145*a* formed at the upper end of the vertical plate 145, thereby preventing the rotation of the movable bracket 150 around the rod 148. This movable bracket 150, as shown in FIG. 2, is moved backward and forward by an air cylinder 169 supported by a bracket 168 projecting rearward from the bracket 147. On the front side of the supporting member 154 a fore plate 162 is fixed, and on each arm 154*a*, 154*b* of the rear side a rear plate 163 having a notch 163*a* in the middle thereof is fixed.

A shaft 164 is rotatably mounted in the lower boss of said clamping member 157, and is clamped by a clamping member 165. This clamping member 165 is secured to the rod of an air cylinder 166 which is of double acting type and is utilized in a single acting mode in the present invention and which is pinned on the rear plate 163, and is tensed by a spring 167 all the times.

Figure 10:
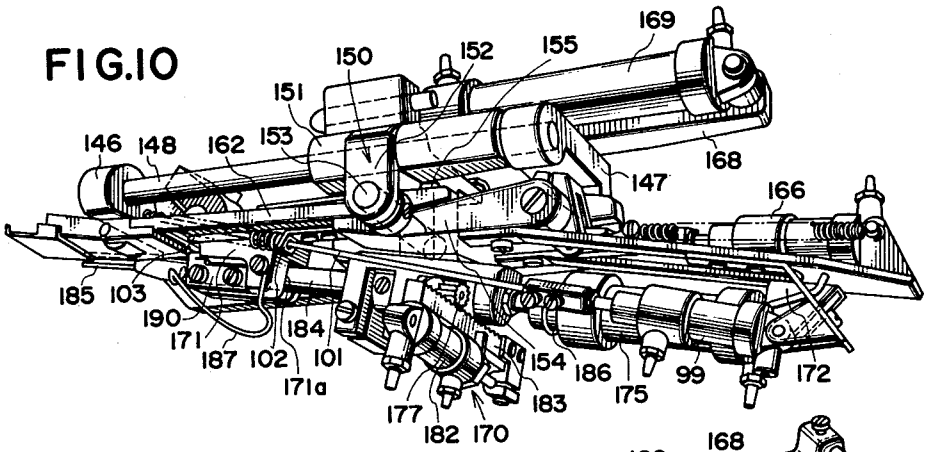
FIG. 10 is a perspective view of a folding means and an accepting means seen from below.
Figure 12:
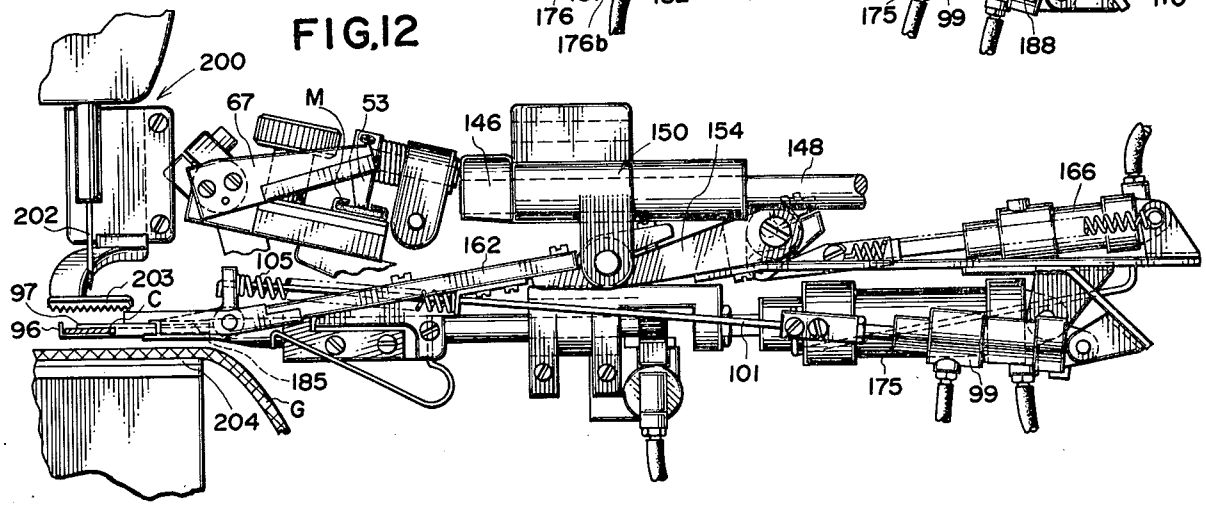

As shown in FIG. 10–FIG. 12, the accepting means 95 is provided with the accepting member 96 having a supine groove 96*a* through an intermediary member 98 fixed to the fore plate 162 mounted on the movable bracket 150. This accepting member 96 is secured to the intermediary member 98 by screws, and those having different groove intervals S are fixed correspondingly to material M of different sizes, thereby preventing the material from swinging sideway, namely in the direction of the width of the material.

The rear end of an air cylinder 99 is mounted on the outside of the notch 163*a* on said rear plate 163, namely on the further side from the vertical plate 145, through a bearing 110, and a connecting member 100 is secured to a rod 99*a* of the air cylinder 99 while a rod 101 is secured to the connecting member 100. The rod 101 is passed through and projecting beyond a bore formed in a spring bearing 102 secured on the fore plate 162, and further passing through an elongated bore 103 formed in the fore plate 162, the rod 101 projects from the rear end portion of a bell crank 104 rotatably mounted on the intermediary member 98 and is bent over in the end thereof. A spring 105 is disposed between the bell crank 104 and the spring bearing 102, while a counterclockwise force is exerted to the bell crank 104 at all times. The presser member 97 having an L-shaped plane is fixed to the front end of the bell crank 104. The folding means 170 is substantially the same as the one in said previous application filed by the present applicant, however, in the present invention, only one folding means is provided between the accepting means 95 and the movable guide 110.

A guide block 171 is secured to the side portion of the fore plate 162 of the movable bracket, and a bracket 172 is fixed to the lower interior portion beyond the notch 163*a* on the rear plate 163.

The rear end of an air cylinder 175 is pivotally mounted on the bracket 172 by a pin 188 and a rod 175*a* of the air cylinder 175 is connected to a rear end portion 176*a* of a coupled member 176 as is shown in FIG. 11. The coupled member 176 has a substantially E-shaped front, being integrally formed by coupling the rear end portion 176*a*, a middle portion 176*b*, and a fore end portion 176*c*. The middle portion 176*b* and the front end portion 176*c* are provided with bores at their centers so as to pass bearings, while slots leading to these bores are provided to facilitate fastening of the bearings which is to be tightened by a screw 178 to avoid the disengagement. A sleeve 179 inserted between the middle portion 176*b* and the fore end portion 176*c* is adapted to link a shaft having the pinion 177 to the shaft 184, and is clamped by a screw 180. As shown in FIG. 25, the shaft having the pinion 177 is provided with the bearing, after which the sleeve, and after which the bearing, and is further provided with the shaft 184 which is inserted at the end portion thereof into the shaft hole of the shaft having the pinion 177 thereby connecting both shafts to each other by a screw 180 of the sleeve 179. They are inserted to the bores from the side of the fore end portion 176*c* of the coupled block 176 toward the middle portion 176*b*, and the bearings are secured by the screw 178 after the pinion 177 reaches the determined position. From the middle portion 176*b* a holding plate 181 is projecting and an air cylinder 182 is suspended on the holding plate thereby interlocking a rack 183 which is actuated by the air cylinder 182 with said pinion 177. The pinion 177 is coupled to the shaft 184 extended forwardly through a groove 171*a* provided on the guide block 171, and fingers 185, 185 for folding are mounted on top of the shaft 184. The air cylinder 175 is supported by a spring 186 fastened to the rear plate 163, and the shaft 184 is supported by a wire spring 187 at the portion of the block 171. These mechanism enable a vertical pivoting of fingers 185, 185 around the pin 188. Usually, the fingers are upwardly tensed by the action of springs 186, 187. Thus, the fingers are pivotally formed for the purpose of enabling pressing of the folded end which is turned over at an angle of 180° against the garment together with the fingers when the fingers advance to the position of the sewing machine in order to sew the folded piece to the garment, details will be mentioned hereinafter. After the fingers are pressed against the garment by the presser and pulled back rearwards by the movable bracket, they return to the upper side of the action of the springs 186, 187. For carrying out these actions, one of the springs 186, 187 will be enough.

Fingers 185, 185 are projecting forwardly in parallel from a tip portion 184*a* of the shaft 184, and an appropriate interval, for example two times as long as the width of the material, is provided between the two fingers. As shown in FIGS. 22(*a*), (*b*), a spindle 184 is provided with a notch 184*b* which, for stopping the swing, is adapted to engage with an end portion 190*a* of a member 190 secured to the guide block 171 when the fingers 185, 185 are rotated in 90°. Owing to this mechanism, the fingers 185, 185 move away upwardly with the rotation thereby reducing the interval between the accepting member 96 and themselves to a possible minimum extent.

As is shown in FIGS. 11, 12, the tips of the fingers are located in the back apart from the trough 52 and the groove of the accepting member 96 when they retreat to their utmost positions to allow the material placed between them. Both fingers are taking substantially vertical relative positions, namely, one is located above the other. Said pinion 177 and a rack 183 adjusted so that two fingers are substantially vertical when the rack 183 projects outwards at its maximum, namely when the rod of the air cylinder 182 retreats to the utmost extent.

A sewing machine 200 is produced by making the following improvements on the Lock Stitch Bar Tack Cylinder Bed sewing machine (hereinafter referred to as the cycle sewing machine) which is known per se.

A sewing head 201 comprises a sewing needle 202, a presser 203, etc. and has a structure known per se, and will not be detailed herein.

Figure 13:
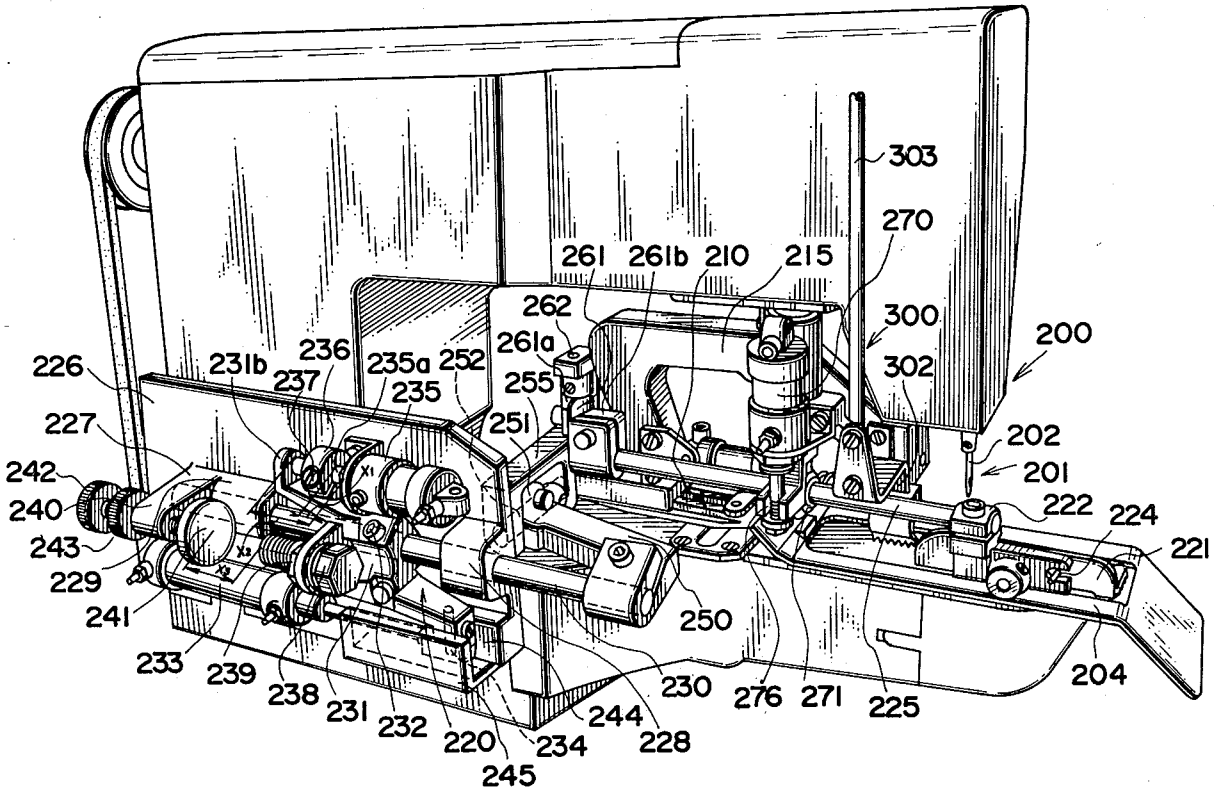
FIG. 13 is a perspective view of a pressing mechanism for the garment.

A mechanism 220 for pressing the garment, as shown in FIG. 13, has a garment presser 221 in the periphery of the sewing head, and is adapted to press the garment and allow it to be placed on an accepting plate 204 to move backward and forward relatively to the accepting plate 204, and the garment presser 221 is adapted to swing simultaneously as the presser on the sewing head and the accepting plate 204 swing correspondingly to the swing of an pivot arm 210 provided in the cycle sewing machine.

The garment presser 221, as shown in FIG. 2, comprises a vertical side frame 221*a* having presser foots 221*b*, 221*c* each integrally formed on the fore portion and the rear portion thereof, and this vertical side frame 221*a* is fixed to the clamping member 222 and is adapted to be oscillated by a pin 223, while its oscillation is limited to a certain extent by a pin 224. Thus, the garment can be pressed evenly as a whole, if it has some spots of different thickness, when the garment presser 221 is so fixed as to be oscillated. Said clamping member 222 is secured to a rod 225. Support of the rod 225 will be detailed hereinafter.

Figure 14:
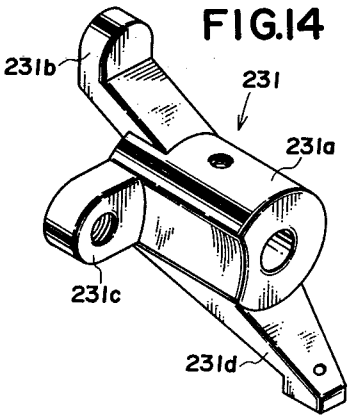
FIG. 14 is a perspective view of a coupled block.

A bearing member 227 is mounted in a horizontal direction in the center of a vertical plate 226 fixed to the cycle sewing machine 200 on the side portion thereof, and bearings 228, 229 are formed respectively on the fore portion and the rear portion of the bearing member 227. A rod 230 is inserted into the through-holes of these bearings and is adapted to be movable backward and forward. As shown in FIG. 14, a coupled block 231 is secured by a bolt 232 approximately on the middle of the rod 230. The coupled block 231 comprises a substantially cylindrical body 231*a*, a projection 231*b* projecting obliquely toward the back and upward, a projection 231*c* projecting sideway, and a supporting portion 231*d* projecting obliquely downward, and into this supporting portion 231*d* a vertical pin 234 projecting upward from the end of the rod of an air cylinder 233 is inserted. The coupled block 231 is connected to the air cylinder 233 by the vertical pin 234, and thereby is allowed to move backward and forward, and the rod 230 slides within the bearings 228, 229 by the movement of the coupled block 231.

An air cylinder 235 is disposed on the vertical plate 226 at the position opposing to the upward projection 231*b* of the coupled block 231, and a rod 235*a* is projecting toward the projection 231*b*. A stopper 236 which is secured by a screw 237 is provided on the rod 235*a*, wherein the retreat of the rod 235*a* is limited by the stopper 236. As a result, an interval x1 is defined between the stopper 236 and the end of the air cylinder 235, and an interval x2 equivalent to the stroke of the air cylinder 235 is defined between the end of the rod of the air cylinder 235 and the projection 231*b*.

A bolt 238 is screwed into the sideway projection 231*c* of the coupled block 231, and is secured at a certain position by a nut 239 for locking, wherein the projecting length of the bolt is adjusted. At a position opposing to this bolt 238, a stopper 241 which is movable backward and forward by a screw shaft is provided on a screw bearing 240 on the bearing member 227. This stopper 241 is linked by a knurled knob 242 and the screw shaft, and is secured by a locking member 243 at a determined position. An interval x3 is defined between the stopper 241 and the bolt 238. Said supporting portion 231*d* slides along between a slide surface 244 formed in the front lower portion of the vertical plate 226 and a guide 245 having an L-shaped section secured on the front lower end of the vertical plate 226.

On the end of said rod 230, a movable arm 250 is secured, and a coupled arm 255 is fixed to a supporting portion 251 of the movable arm 250 through a horizontal shaft 252 to be pivoted around the horizontal shaft 252.

Figure 15:
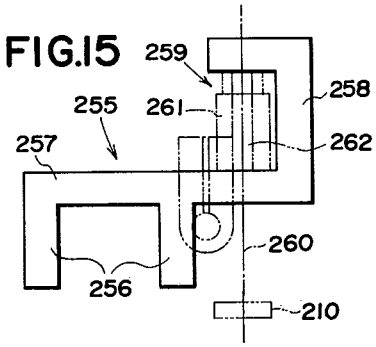
FIG. 15 is a perspective view of a coupled arm.
Figure 20A:
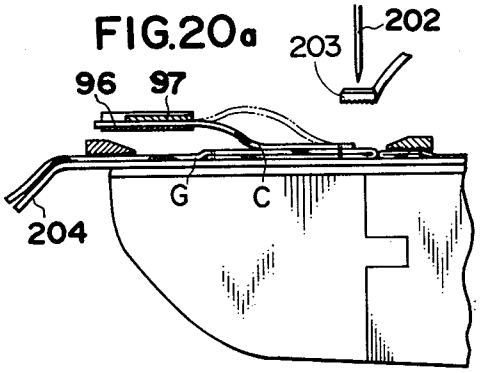
Figure 20B:
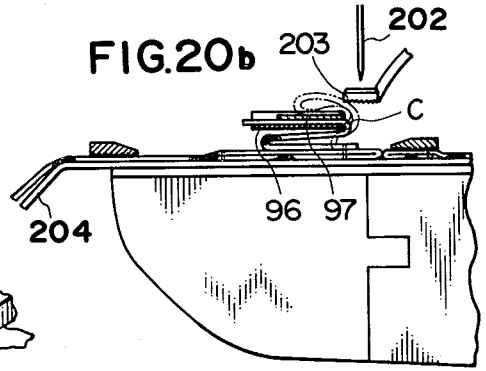

As shown in FIG. 15, the coupled arm 255 comprises a horizontal member 257 which is laterally extended on one side thereof and has downward brackets 256, 256, and which further has an L-shaped member 258 extended upwardly from the end thereof, and a bearing portion 259 is formed by the right end portion of the horizontal member 257 and the L-shaped member 258.

It is preferable that the bearing portion 259 is formed so that the axis thereof falls on the extention of the oscillating axis 260 of a pivot arm 210 provided in the cycle sewing machine 200.

An oscillating arm 261 is provided with a boss portion 261*a* which is pivotally fixed on said bearing portion 259 through a shaft 262 and a holder 261*b* which projects obliquely laterally from this boss portion 261*a*, and the rear end of said rod 225 is secured on the holder 261*b*.

Said structure allows the rod 225 to move backward and forward with the to-and-fro movement of the rod 230 and to swing vertically around the shaft 252, and further, to swing sideway around the shaft 262.

As the rod 225 must be oscillated simultaneously with the oscillation of the presser 203 performed from side to side of the needle 202 by the oscillation of the arm 210, said air cylinder 270 is secured to the side of a presser arm 215 fixed to the pivot arm 210, and the middle portion of the rod 225 is adapted to be supported by a slide bearing 271 which is of self-aligning type and is adapted to move up-and-down by the rod of the air cylinder 270. Structures of the presser arm 215 and the presser 203 are known in the cycle sewing machine and are detailed in the prior application by the present applicant.

Figure 16:
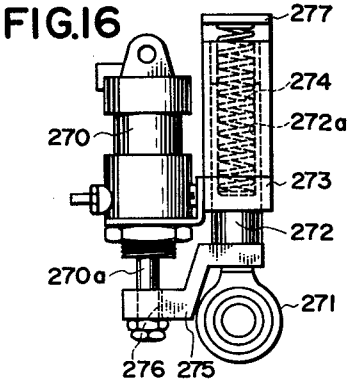
FIG. 16 is an elevational view of a swivel bearing.

As shown in FIG. 16, a sliding shaft 272 having a slide bearing 271 at the lower end thereof is adapted to slide up-and-down in a rigid can 273 which is secured to the side portion of the presser arm 215 along with the air cylinder 270, and is downwardly spring-biased at all times by a compression spring 274 disposed between a bore 272*a* formed in the middle portion of the sliding shaft and an L-shaped member 277 secured to the rigid can 273. A connecting piece 275 secured to the sliding shaft 272 is provided with a groove 276 in which a rod 270*a* of the cylinder 270 is slidably disposed, and the slide bearing 271 is raised by the rise of this rod 270*a*. As a result of this mechanism wherein the rod 255 is supported by the slide bearing 271 of self-aligning type, and the slide bearing 271 and the rod 270*a* of the cylinder 270 are connected in such a manner that the relative movement between the two is possible, the rod 225 can independently oscillate vertically and horizontally as well even when the rod 270*a* of the cylinder is projecting downwardly.

A slackening mechanism 300 is for the formation of a space through which a belt is inserted between the belt loop and the garment.

Figure 17:
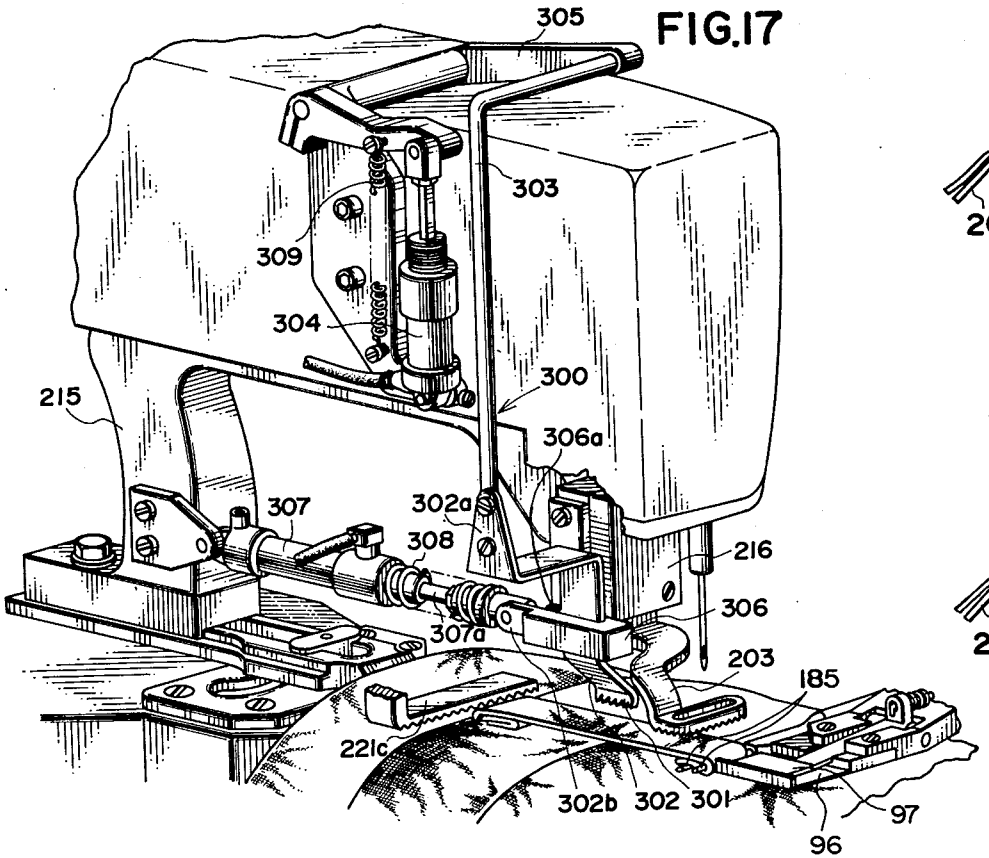
FIG. 17 is a perspective view of a slackening mechanism.

As shown in FIG. 17, a slackener 302 having a saw-tooth 301 in the lower end thereof is disposed between the presser 203 and the presser foot 221*c* in the back, laterally bent, and further is bent vertically wherein a vertical portion 302*a* is secured to the lower end of the supporting bar 303. The supporting bar 303, as being loosely engaged at the end portion thereof within a bore of an arm 305 connected to the rod of a single acting air cylinder 304, is lifted by said single acting air cylinder 304 secured to the side portion of the body of the sewing machine, and is lowered by a spring 309. By lowering the supporting bar 303 by the spring 309, the eating of the saw-tooth 301 into the garment can be reduced. The slackener 302 is loosely inserted in a groove 306*a* of a guide 306 secured to a guide block 216 for the presser 203, wherein the slackener is adapted to move vertically within the groove, and it further is provided with a rearwardly projecting plate 302*b* which is pivotally mounted on a rod 307*a* of an air cylinder 307 pivotally mounted on the rear end of the presser arm 215. This mechanism enables the slackener 302 to perform an additional to-and-fro movement. Numeral 308 designates a spring which thrusts out the slackener 302 invariably forwardly by the spring.

Figure 18:
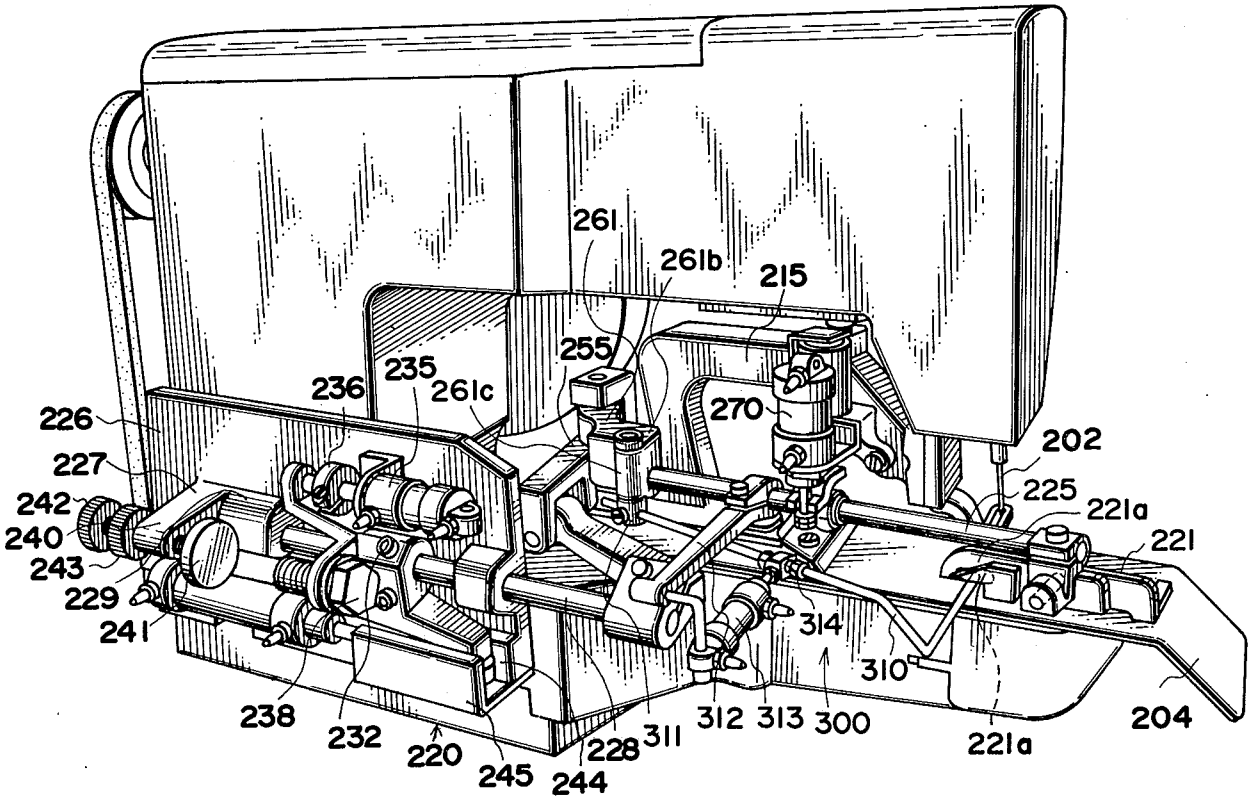
FIG. 18 is a perspective view of another embodiment of the slackening mechanism.

Shown in FIG. 18 is another embodiment of the slackening mechanism 300. One end of a slackening bar 310 is disposed in an elongated bore 221*d* so that the bar 310 is projected from said bore 221*d* formed in the side frame 221*a* of the garment presser 221, and the other end thereof is secured to a shaft 311 rotatably fixed to a bearing 261*c* which is laterally projected from the holder 261*b* of said oscillating arm 261. A supporting arm 312 is laterally projected from the middle portion of the rod 225 having the garment presser 221 secured at the front end portion thereof, and an air cylinder 313 is suspended by this arm 312. The slackening bar 310 is mounted on the rod of the cylinder 313 through a supporting member 314 of an self-aligning type.

The slackening mechanism, as an example of its first application, is employed when the four air cylinders 122, 124, 125, and 126 are provided on said plate 119, and as an example of its second application, is employed when two of them, the cylinder 122 and the cylinder 125 excluding the most exterior cylinder 126 and an interior one, for example, the cylinder 124.

Figure 19:
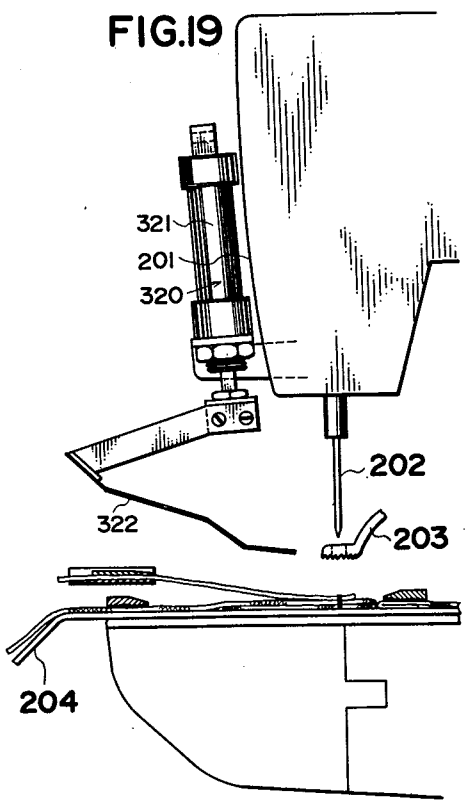
FIG. 19 is a perspective view of a folding-back guide mechanism.

Shown in FIG. 19 is a folding-back guide mechanism 320 which is preferred to be used for folding back the cut piece after one end thereof is sewn. A single acting air cylinder 321 is fixed on the front end of the sewing head 201, and the square rod which is normally set free above the spring provided within the cylinder is provided with a plate spring 322 on the lower end thereof. This plate spring 322 is mounted on the rod in a substantially oblique position. But for this guide mechanism, as shown in FIG. 20(*a*), the cut piece C curves upwardly as illustrated by imaginary lines as it it folded over after one end thereof having been sewn to the required portion of the garment G, and hits against the presser 203, whereby the cut piece is caught between the presser member 97 and the presser 203. Hence, as shown in FIG. 20(*c*) it is necessary to push the cut piece C by the plate spring 322 actuating the cylinder 321 when it is folded over. The cut piece is moved to the right in the drawing while being pushed by the plate spring 322 and kept between the accepting member 96 and the passer member 97 on the other end thereof, and is folded over, wherein the cut piece is not bent upwardly as shown in FIG. 20(*d*) and is passed through under the presser 203 without hindering the progress of the accepting member 96 and the presser 97 because of the plate spring pressing the cut piece.

In said belt looper apparatus, it is possible to use oil cylinders instead of air cylinders for actuating each portion, as would be apparent to the skilled in the art. And further, it is also possible to employ double-acting cylinders instead of single acting ones.

Now the operation of the apparatus according to the present invention having said structures will be detailed. As to the control means, e.g. switches, etc. of each member of said apparatus, no description is given herein because the arrangement of switches, etc. as well as the sequence based thereon will be apparent to the skilled in the art.

At first, adjustment of the length of a band loop to be sewn to the garment is carried out in accordance with the length of a piece to cut off. The fastening knob 64 shown in FIG. 3 is loosened and the supporting member 62 is shifted to locate the stopper 61 at a predetermined position. This location is facilitated and speeded up by the use of the pointer 65 and the scale 66.

In the apparatus according to the present invention, a cut piece led onto the accepting member 96 is partly projecting from the end of the accepting member 96 toward the rear side in FIG. 2 in a certain invariable length regardless of the whole length thereof, while the projecting length from the left end of the accepting member 96 toward the front differs according to the whole length thereof. As is obvious from the descriptions to be found later, when the length of the cut piece differs from each other, adjustment can be carried out merely by changing the shifting distance of the garment placed on the accepting plate 204 by the garment presser 221 in the backward direction, namely toward the body of the sewing machine. This is performed merely by changing the interval x3 between the stopper 241 and the bolt 238 shown in FIG. 13. On the surface of the bearing 229 provided in the bearing member 227, a scale which is not shown in the drawings is provided, and the end of the stopper 241 reads out the representations of said scale for the adjustment of the retreat length of the garment presser 221.

The material M for band loops is formed in advance and is placed on a proper position which is not shown in the drawings of the apparatus according to the present invention. The end of the material M is manually introduced into the trough 52 and the delivery pawl 53 is manually lifted, and thereby the end of the material M is accorded with the knife edge 68. After setting the material M this way and subsequently putting on the actuating switch, the air cylinder 55 starts to work and the delivery pawl 53 starts to advance. The portion delivered from the trough is placed on the accepting member 96, and when the cylinder 55 comes to its stroke end and the air on the side of the return chamber of the air cylinder 99 of the accepting means 95 is extracted, the bell crank 104 is pivoted around a pin 104*a* by the spring and whereby the presser member 97 presses the material M between the accepting member 96 and itself (FIG. 11). Thereafter, the cutter 67 is actuated and the material M is cut.

As seen in FIG. 4, when the trough 52 is provided with a seam-detecting mechanism 80, the seam portion 10 in the material is automatically detected and eliminated while the material is being delivered. The detecting portion 90 is located at the nearest possible position to the delivery pawl 53, where a detected portion of the material M is led onto the accepting member 96 by the second delivery. The detection of seam portions in the material by this detecting portion 90 is performed by the following two methods. The first method is employed in such a case that the material of a certain length has a seam portion in the middle thereof and that the detection is carried out while the material M is being fed by the delivery pawl 53. The second method is employed when a seam portion is included in the edge of the material of a certain length, as shown in FIG. 4, that is, in such a case that the detecting portion 90 rides on the seam portion right at the moment delivery pawl 53 returns to the end of its backward stroke and is prepared for the next delivery. In the former case, the detected material is cut off and eliminated after a portion of the material delivered onto the accepting member 96 is delivered toward the sewing machine, and in the latter case, consecutive two cut pieces are eliminated as they may include seam portions.

The end of the plate spring 69*a* presses the material against the trough after the material is cut and the cutter 67 is in a downwardly pivoted state, and while maintaining this state, the delivery pawl can be returned to the starting position sliding over the surface of the material without pulling it back.

As an operator attending the sewing machine steps on the foot switch (not shown) after the cutting of the material M is finished, the movable guide 110 having been on standby is actuated and starts to move in the direction of the delivery of the material. At first, a 4-cylinder method will be described. When high pressure air is supplied to the pressing chamber of the air cylinder 124 and the return chamber of the air cylinder 126, each having same diameter, the detect plate 117 makes a progress, however, at the projecting end of the air cylinder 124 and the end of the back stroke of the air cylinder 126 the detent plate 117 is caught between said vertical portion 129*b* of the square rod 129 and a member 128*a*, and further progress thereof is thereby prevented. This stoppage is done at the position where the portion of the cut piece projecting from the rear end of the accepting member 96 toward the rear side meets with the presser 203 of the sewing machine. The movable guide 110 temporarily stopped is kept stopped, and consequently the accepting means 95 and the folding means 170 are simultaneously moved forward in the direction of the sewing machine, namely, in a lateral direction crossing at right angles with the delivery direction by the air cylinder 122 for delivery. The air cylinder 169 fixed to the movable guide 110 is actuated and the movable bracket 150 is moved along the rod 148. The holder 154 is rotatably associated with the movable bracket 150, and a shaft 156*a* which engages with grooved cam 158 projects from the rear portion of the holder, wherein each end portion of the accepting means 95 fixed to the holder 154 and the folding means 170 moves in a curved line. These situations are equivalent to those described in the prior application by the present applicant. The object of these arrangements is the same, too. The movable bracket 150 at first located at the position shown in FIG. 11 comes to the position shown in FIG. 12 after the movement is over. Namely, one end portion of the cut piece C, that is, the end portion projecting from the accepting member toward the cutter 67, comes to the position under the presser 203 of the sewing machine 200 and the substantial middle portion of the cut piece along the longitudinal direction thereof comes right under the needle 202. Before the lateral delivery of the cut piece C toward the sewing machine is started, the garment, for example trousers G are preparedly placed on the accepting plate 204 of the sewing machine, and by extracting the air in the return cavity of the air cylinder 270 the spring 274 is actuated to push down the garment presser 221 which thereby holds the garment between the accepting plate 204 and itself.

When the cut piece C is laterally delivered until it reaches the upper place of the accepting plate, a portion of the cut piece to be sewn first is located under the presser 203 which accordingly is lowered to secure the portion to be sewn. Before pressing by the presser 203, the air in the pressing chamber of the air cylinder 166 is extracted and whereby the clamping member 157 is pivoted by the spring 167 and the shaft 156 is slightly rotated. Due to the pivotal rotation of the shaft 156, the shaft 156*a* which is eccentric relatively to the shaft 156 is pivoted by the grooved cam 158, and accordingly the accepting means 95 and the folding means 170 are downwardly rotated in a degree corresponding to the degree of eccentricity, while the accepting member 96 and the presser member 97 are downwardly rotated. As a result of this downward rotation, the lower surface of the accepting member 96 contacts the garment, and the cut piece is securely pressed at the portion to be sewn to the garment by the presser 203, whereby a precise positioning is performed. After the cut piece is secured at one end by the presser 203, the pressing chamber of the air cylinder 166 is supplied with air, whereby the accepting member 96 having been downwardly rotated restores the original state and a very narrow aperture is formed between the lower surface of the accepting member 96 and the garment. Under this condition, high pressure air in the return chamber of the air cylinder 126, as well as that in the pressing chamber of the air cylinder 124 is extracted and is supplied to the pressing chamber of the air cylinder 122, wherein the detent plate 117 is pushed out and thereby after all the movable guide 110 is pushed out. The pushing is continued until the stroke end of the air cylinder 122 is reached, or until the stopper 130 hits against the rear end of the bearing 112 in the case the stopper 130 is mounted on the rear end of the rod 113 as shown in FIG. 9. In this case, the material is held between the accepting member 96 and the presser member 97 which is pressed by the spring 105, therefore, a proper pressing force can be maintained by adjusting the spring force properly. As a result, as the movable guide 110 is impelled by the air cylinder 122, the accepting member 96 and the presser member 97 are shifted forward while holding therebetween the cut piece with its one end secured by the presser 203 and slidingly guiding the other end of the cut piece. This position is shown in FIG. 21(a). The reason for not providing a large interval between the position P where the cut piece is to be sewn and the accepting member 96 and the presser member 97, as illustrated in FIG. 21(a), at the beginning is as follows. In order to receive the end of the material fed from the trough 52 onto the accepting member 96, it is necessary to locate the accepting member 96 as close as possible to the trough end side. However, if the accepting member is too close to the trough side, the portion of the cut piece projecting from the accepting member becomes too short and therefore the portion to be sewn slips off the right position when it is pressed by the presser, because the presser alone moves while the accepting member is stationary, and after all a firm sewing cannot be achieved. For avoiding such drawbacks, the accepting member 96 and the presser member 97 are shifted forward after the cut piece is delivered to the sewing machine and the cut piece is secured at one end thereof by the presser 203. When the accepting member 96 and the presser member 97 are shifted forward, the sewing 3 is performed at the position P. This sewing is bar tacking as described in the prior application. After the sewing to the one end portion is finished, the presser 203 is lifted, then movable guide 110 is withdrawn by the cylinder 122, and the cut piece is folded over. In this case, if a folding-back guide mechanism 320 shown in FIG. 19 is provided, the folding back will be ensured. As shown in FIG. 21(b), the cylinder 122 comes to the limit of its stroke end, when the accepting member 96 and the presser member 97 pass under the position of the presser 203 and come back to such a position to allow the presser 203 to press the garment, namely the starting position of the detent plate 117. Martonair's cylinder described in the prior application can also be use for this purpose.

Meanwhile, as shown in FIG. 13, the air cylinder 233 provided in the mechanism 220 for pressing the garment and the air cylinder 235 have the same diameters and are actuated with the same air pressures. At first, the air cylinder 235 is actuated and its rod 235*a* is projected as far as the stroke end, namely by the distance x2. In this situation, when the air cylinder 233 is actuated, the coupled block 231 makes a progress and the projection 231*b* hits against the end of the rod 235*a* thereby coming to a temporary halt. In this first position the first sewing of the cut piece is performed. In this case, as shown in FIG. 24, the return of the rod is perfectly prevented if any shocks should be given thereto, by disposing a spring 362 between the stopper 236 and a nut 361 by which the cylinder 235 is secured relatively to a bracket 360. Though in said embodiment the cylinders 233, 235 are of the same diameters and actuated by the same pressures, the cylinder 235 may have a larger diameter than the cylinder 233 while exerting the same pressure to each for preventing shocks. Then the garment presser 221 is moved simultaneously with the movement of said movable guide 110. When the air in the pressing chamber of the air cylinder 235 is extracted, the balance of power having been maintained between both cylinders 233 and 235 comes to be lost, then the rod 235*a* is withdrawn and is halted by the stopper 236. That is, the rod 235*a* retreats by the distance x1, while the projection 231*b* advances by this distance x1. With the advancement of the projection 231*b*, the garment presser 221 is consequently advanced by the distance x1, thereby advancing the garment on the accepting plate 204 by the distance x1 relatively to the accepting plate 204. The resultant position is shown in FIG. 21(b). The first seam may come under the needle if the cut piece is simply folded over, however, in the present case, the garment presser 221 is shifted forming an interval approximately equivalent to x1 between the first seam and the needle. The second seaming is performed hereat. After the garment presser is shifted, the presser 203 is lowered and then the cut piece is pressed at the periphery of the portion to be sewn, and thereafter the presser 203 is again lifted.

After the second sewing 4 is finalized and the presser 203 is lifted, the cut piece is once again folded over. The high pressure air in the return chamber of the cylinder 122 is extracted and the high pressure air is then supplied to the pressing chamber of the upwardly-directed cylinder 137, thereby the column 136 comes to be projected upwardly from the plate 119. Then the high pressure air is supplied to the pressing chamber of the cylinder 125, and the detent plate 117 is advanced to hit against the column 136. At this time, both pressing chamber and return chamber of the air cylinder 126 are not supplied with the high pressure air. With the action of the air cylinder 125, the high pressure air is supplied to the return chamber of the cylinder 233 of the presser mechanism, the rod 230 retreats by the distance ($x_1 + x_3$), thereby the garment is moved backward by ($x_1 + x_3$) by the garment presser 221. After the advancement of the detent plate 117 and the pullback of the garment, the high pressure air is supplied to the pressing chamber of the air cylinder 175 of the folding means 170, the fingers 185, 185 are advanced to hold therebetween the free end portion of the cut piece, thereafter the rack is actuated by the action of the air cylinder 182 and the pinion 177 is rotated, the fingers 185, 185 are rotated approximately in a 270° arc, so that the free end side of the cut piece is drawn from between the accepting member and the presser member and is folded over in 180°. After folding over of the free end side of the cut piece is finished, the air in the pressing chamber of the air cylinder 125 is extracted and the air in the pressing chamber side of the vertical cylinder 137 too is extracted. As a result, the column 136 is drawn back under the plate 119. Subsequently, the high pressure air is supplied to the pressing chamber side of the air cylinder 124 and the return chamber side of the air cylinder 126, and, at the same time, the air in the pressing chamber of the air cylinder 304 provided in the slackening mechanism 300 is extracted and the slackener 302 is lowered by the spring 309 so that the high pressure air is supplied to the return chamber side of the air cylinder 307. As a result, the detent plate 117 is pulled back by the distance Y, the end portion of the cut piece folded over by the fingers 185, 185 are located under the needle, and the middle portion of the cut piece is pulled back by the slackener 302. In this condition, the accepting member 96 and the presser member 97 along with the fingers oscillate downwardly due to the air venting of the air cylinder 166 and the action of the spring 167, and the presser 203 is lowered to press the folded end together with the fingers to the garment. At this time, the fingers 185, 185 further oscillate around a pin 188 resisting springs 186, 187. After the pressing with the presser 203 is finished, the high pressure air is supplied to the return chamber side of the air cylinder 169 thereby moving the movable bracket 150 backwards. As a result, the folding means too retreats and the fingers are pulled out of the folded end, then the high pressure air is supplied to the return cavity of the cylinder 175 on the folding means 170 and the fingers are pulled back to their original positions and the rack 183 and the pinion 177 are actuated by the air cylinder 182, and the fingers restore their original vertical positions. The movable bracket 150 starts to draw back sideways to restore their original starting position. The sewing 2 is carried out on the cut piece at the portion pressed by the presser 203, so that the belt loop is completed. With the completion of sideward drawing back of the movable bracket 150, the air in the pressing chamber side of the air cylinder 124 and the return chamber side of the air cylinder 126 is extracted, the high pressure air is supplied to the return chamber side of the air cylinder 122, and the detent plate 117 and, in consequence, the movable guide 110 are returned to their original starting positions to prepare for the following movements.

Now the actions in the two-cylinder system will be described. In the following description, however, the movement of the garment itself will not be referred to, as it is the same as the aforementioned. As the material M is supplied and the cutting of the material held between the accepting member 96 and the presser member 97 is finished, the air cylinder 137 starts to move thereby allowing the column 136 to project. When the column 136 is projected, the high pressure air is supplied to the pressing chamber side of the air cylinder 125, the movable guide 110 starts to move forward, and the detent plate 117 hits against the column 136 thereby halting the advance of the movable guide 110. In this condition, the movable bracket 150 is carried sideways, and one end of the cut piece comes to be located under the presser 203. After the accepting member 96 and the presser member 97 are downwardly rotated, the presser 203 is lowered to press the one end of the cut piece. After finishing the pressing, the accepting member and the presser member right themselves from the rotated position and the air in the air cylinders 137 and 125 is vented. Subsequently, the high pressure air is supplied to the pressing chamber side of the air cylinder 122, the movable guide 110 is further advanced, and the first sewing 3 is performed at the portion having been pressed by the presser. This state is illustrated in FIG. 21(a). Then the high pressure air is supplied to the return chamber side of the air cylinder 122 thereby allowing the movable guide to draw back, and the cut piece is folded over. The sewing 4 performed after folding over the cut piece is illustrated in FIG. 21(b).

After the second sewing 4, the presser 203 is lifted, the air cylinder 313 provided in the slackening mechanism 300 is actuated to rotate the slackening bar 310 around the shaft 261c as shown in FIG. 18, so that a substantially L-shaped end of the bar 310 comes on the rear side of the seam 4, namely, on opposite side of the seam 3 with respect to the seam 4, as illustrated in FIG. 21 (c). As said slackening bar 310 is adapted to slacken the belt loops and to facilitate the insertion of the belt into the loops, the degree of slackening increases as the bar goes away from the seam 4. The degree of slackening can be determined in consideration to the thickness of the belt, etc. While maintaining the slackening bar 310 in a protruded position, the cut piece is again folded over.

Figures 21C, 21D, 21E:
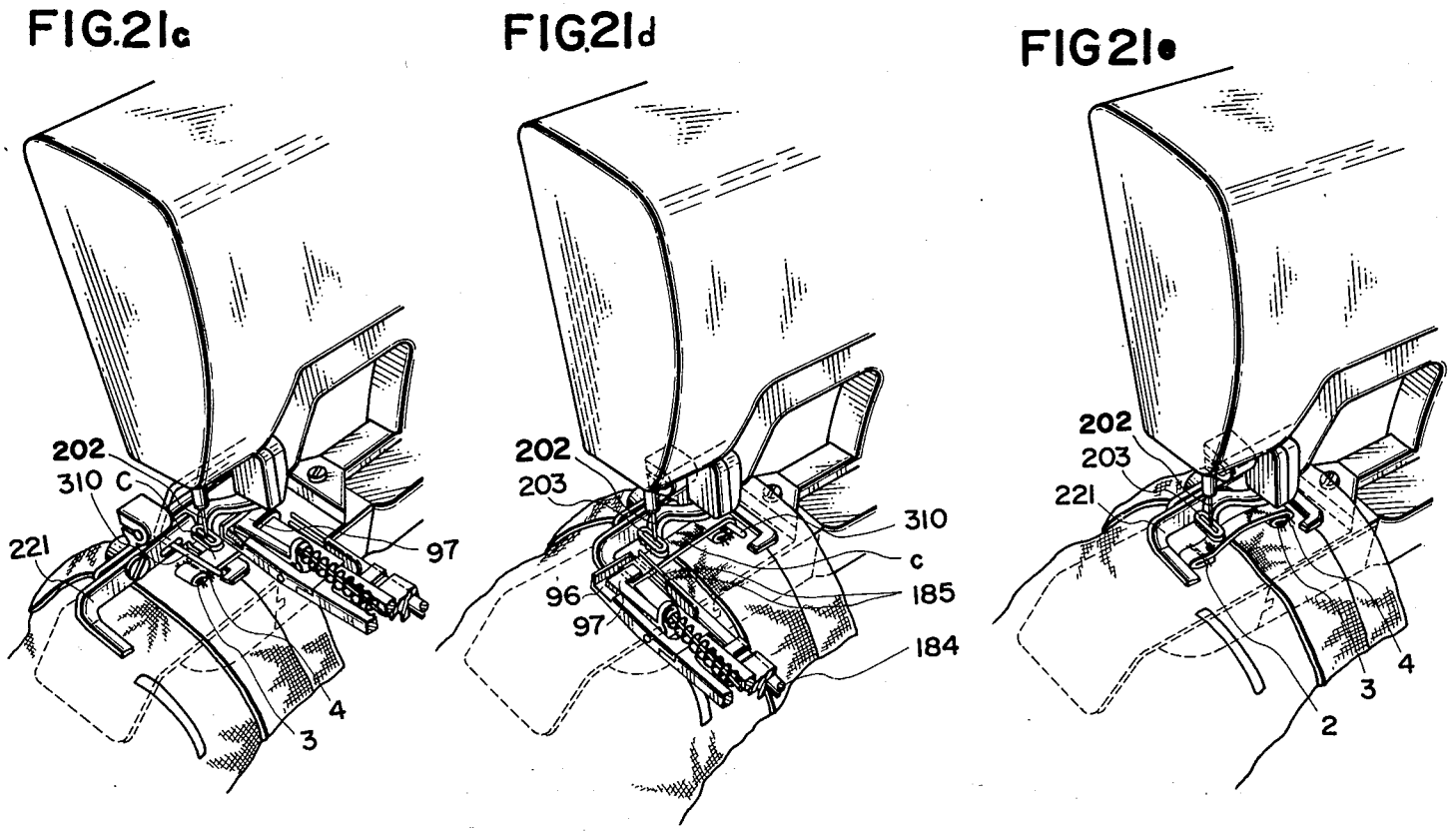

The air in the return chamber side of the air cylinder 122 is extracted, the high pressure air is supplied to the pressing chamber side of the upwardly-faced air cylinder 137 thereby allowing the column 136 to protrude, the high pressure air is further supplied to the pressing chamber side of the air cylinder 125, the detent plate 117 is advanced until it hits against the column 136, and, as shown in FIG. 21(d), at the end of advance of the movable guide, the free end of the cut piece, with one end having been sewn at two spots, is held in a very narrow area between the accepting member 96 and the presser member 97. In this condition, the fingers 185, 185 of the folding means 170 are advanced thereby allowing the free end side of the cut piece to be held between both fingers located over and under the cut piece. This state is illustrated in FIG. 21(d).

The free end portion of the cut piece, having been slightly held between the accepting member 96 and the presser member 97, slips out from between the two members by the rotation of the fingers, and the top end thereof rotates substantially in a 180° arc to be held by the both fingers. When both fingers are rotated and are substantially horizontally disposed to each other, the presser 203 comes over them. Subsequently, pressing is performed by the presser 203, the fingers are drawn out, and the sewing is carried out, similarly to the said case. This is illustrated in FIG. 21(e). Then the fingers restore their original positions, and so does the movable guide 110. This restoration of the movable guide is performed by venting the air in the pressing chamber side of the air cylinder 125 and supplying the high pressure air into the return chamber side of the air cylinder 122. During the third sewing, the next cut piece is supplied to the accepting member 96 returned to its original position as a preparation for the following movement.

What is claimed is:

1. A belt looper apparatus comprising a delivery means for delivering an elongated material, an accepting means for accepting the delivered material, a cutter for cutting the material secured on said accepting means, a folding means which is located between the accepting means and the cutter and includes two fingers, a cycle sewing machine, a guide upon which said accepting means and said folding means are mounted to move sideways toward the sewing machine, a garment-pressing means mounted on the cycle sewing machine and having a garment presser, said guide and said garment presser being movable in a direction equivalent to that of the delivery of the material, and a slackening means, the accepting means and the folding means being rotatable slightly by a groove formed on a vertical plate of the guide and an eccentric shaft associated with the groove, whereby the under surface of the accepting means contacts the garment.

2. A belt looper apparatus as claimed in claim 1, wherein a detecting means for seams in the elongated material is mounted on said delivery means.

3. A belt looper apparatus as claimed in claim 2, wherein said seam-detecting means is located as near as possible to a delivery pawl and a seam detected by this detecting means is not included in a unit of material of a predetermined length delivered by a single delivery, but is included in a succeeding unit.

4. A belt looper apparatus as claimed in claim 3, wherein said groove forms a grooved cam, whereby said accepting means and said folding means move on curved tracks during their sideward movement.

5. A belt looper apparatus as claimed in claim 1, wherein a folding-back guide means is provided.

6. A belt looper apparatus as claimed in claim 1, wherein said movable guide is actuated by two cylinders.

7. A belt looper apparatus as claimed in claim 6, wherein said slcackening means has a substantially L-shaped rod which is adpated to project from a bore in the garment presser.

8. A belt looper apparatus as claimed in claim 7, wherein said groove forms a grooved cam, whereby said accepting means and said folding means move on curved tracks during their sideward movement.

9. A belt looper apparatus as claimed in claim 1, wherein said folding means comprises a substantially E-shaped coupling block, a shaft having at one end thereof two fingers for folding an end portion of the material in nipping engagement therewith and at the other end thereof a pinion for engagement with a rack movably mounted on the coupling block, and a cylinder pivotally mounted on the holder for moving the shaft axially, the shaft being rotatably mounted in one portion of the coupling block, a rod protruding from the cylinder being mounted in another portion of the coupling block, the shaft being biased by at least one spring.

10. A belt looper apparatus as claimed in claim 9, wherein a detecting means for seams in the elongated material is mounted on said delivery means.

11. A belt looper apparatus as claimed in claim 10, wherein said groove forms a grooved cam, whereby said accepting means and said folding means move on curved tracks during their sideward movement.

12. A belt looper apparatus comprising a delivery means for delivering an elongated material, an accepting means for accepting the delivered material, a cutter for cutting the material secured on said accepting means, a folding means which is located between the accepting means and the cutter and is provided with two fingers, a cycle sewing machine, a guide upon which said accepting means and said folding means are mounted for movement sideways toward the cycle sewing machine, a garment-pressing means mounted on the cycle sewing machine, and a slackening means, the garment pressing means comprising a rod provided with a garment presser on one end portion thereof, a coupled arm having a pair of downwardly-faced brackets and a sidewardly-faced bearing portion with the axis of the latter being above the axis of swing of a pivot arm provided in the sewing machine, and a movable rod adapted to move along the same direction with that of the delivery of the material, the rod and the movable rod being coupled to the coupled arm through an oscillating arm and a movable arm respectively, and said guide being adapted to move along the same direction with that of the movable rod.

13. A belt looper apparatus as claimed in claim 12, wherein a detecting means in the elongated material is mounted on said delivery means.

14. A belt looper apparatus as claimed in claim 13, wherein said accepting means and said folding means move on curved tracks during their sideward movement.

15. A belt looper apparatus as claimed in claim 12, wherein a folding-back guide means is provided.

16. A belt looper apparatus as claimed in claim 15, wherein said accepting means and said folding means move on curved tracks during their sideward movement.

17. A belt looper apparatus as claimed in claim 12, wherein said movable guide is actuated by two cylinders.

18. A belt looper apparatus as claimed in claim 17, wherein said accepting means and said folding means move on curved tracks during their sideward movement.

19. A belt looper apparatus as claimed in claim 17, wherein said slackening means has a substantially L-shaped rod adapted to project from a bore of the garment presser.

* * * * *